United States Patent [19]

Markus

[11] Patent Number: 4,497,281

[45] Date of Patent: Feb. 5, 1985

[54] HEATER

[75] Inventor: Gerardus A. Markus, S/Gravenzande, Netherlands

[73] Assignee: BS&B Engineering Company Inc., Houston, Tex.

[21] Appl. No.: 602,271

[22] Filed: Apr. 23, 1984

Related U.S. Application Data

[63] Continuation of Ser. No. 494,689, May 17, 1983, abandoned, which is a continuation of Ser. No. 257,128, Apr. 24, 1981, abandoned.

[30] Foreign Application Priority Data

Jun. 17, 1980 [GB] United Kingdom ..... 80190825

[51] Int. Cl.[3] ..... F22B 37/10

[52] U.S. Cl. ..... 122/248; 122/19; 122/195

[58] Field of Search ..... 122/248, 195, 10, 18, 122/19; 129/347, 361, 350 R

[56] References Cited

U.S. PATENT DOCUMENTS

| | | | |
|---|---|---|---|
| 1,538,436 | 5/1925 | Kohlmeyer | 122/248 |
| 3,529,579 | 9/1970 | Wanson | 122/248 |
| 3,841,273 | 10/1974 | Finger et al. | 122/248 |
| 3,962,999 | 6/1976 | Rehm | 122/248 |

FOREIGN PATENT DOCUMENTS

| | | | |
|---|---|---|---|
| 459684 | 1/1937 | United Kingdom | 122/248 |
| 1407905 | 10/1975 | United Kingdom . | |

*Primary Examiner*—Edward G. Favors
*Attorney, Agent, or Firm*—Delmar L. Sroufe

[57] ABSTRACT

A heater for heating a process fluid in which a cylindrical main chamber has a number of high intensity burners mounted therein to project products of combustion into the main chamber in a direction transverse to the axis of the main chamber. An annular secondary chamber surrounds the longitudinal walls of the main chamber, a first set of heat exchanger tubes being provided in the main chamber and a second set in the secondary chamber. Gases flowing from the burners pass over the first set of heat exchanger tubes, and then through at least one inlet to the secondary chamber, where they pass over the second set of heat exchanger tubes and out through a flue outlet at the top. A refractory shield may be provided adjacent the burners to guide the gases from the main chamber into the secondary chamber, and a further heat shield may be provided between the main chamber and the secondary chamber.

8 Claims, 2 Drawing Figures

Figure 1:
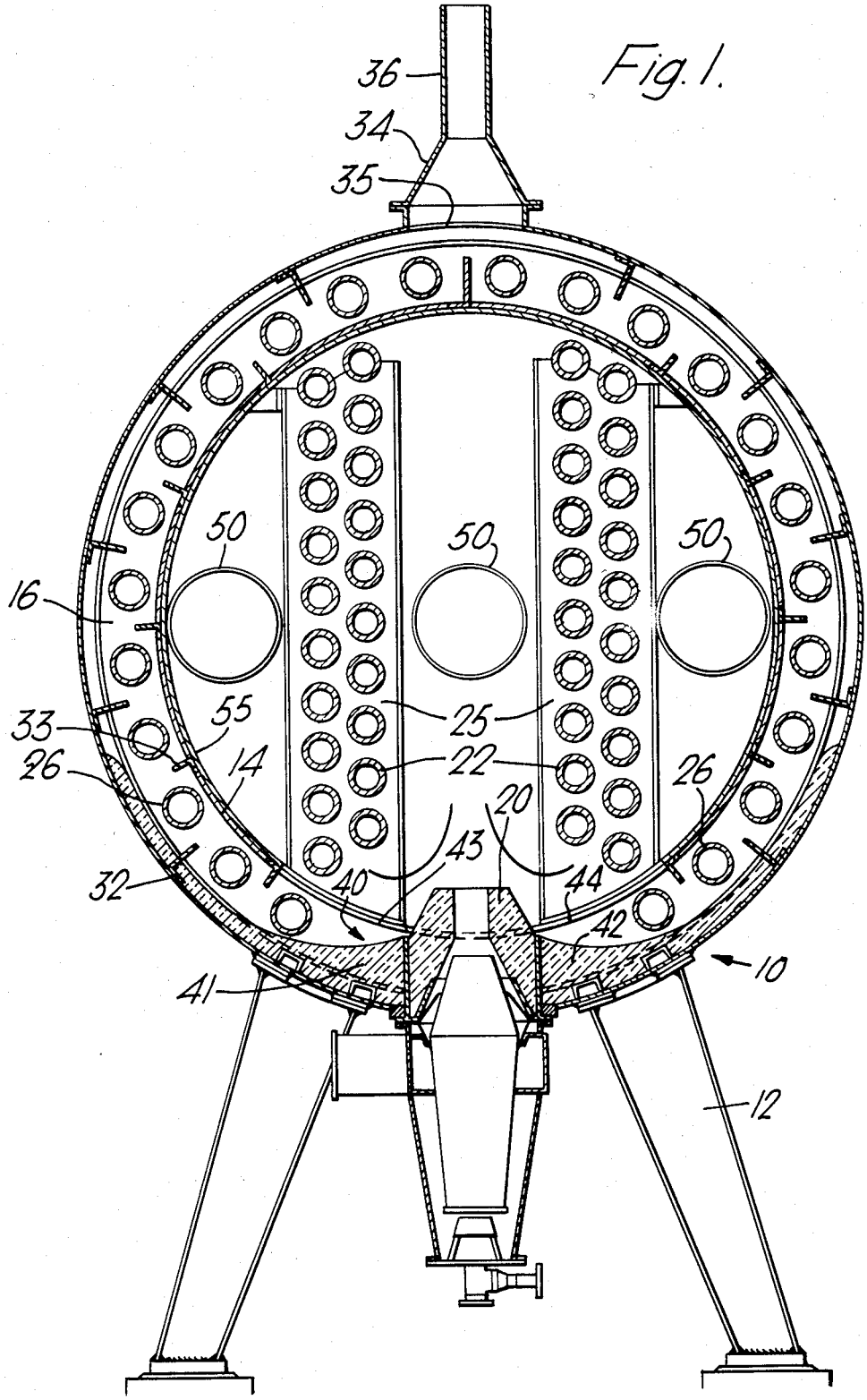

36
34
35
50
50
50
16
33
26
55
14
25
22
26
20
43
40
44
42
32
41
10
12

HEATER

This application is a continuation of U.S. patent application Ser. No. 494,689, filed May 17, 1983 now abandoned which was a continuation of U.S. patent application Ser. No. 257,128, filed Apr. 24, 1981 now abandoned.

The present invention relates to a heater for heating a process fluid.

Various forms of such heater are known in the art and one particular type involves the use of high intensity burners which are mounted to project their products of combustion into a main chamber in which are mounted a number of heat exchanger tubes for heating the process fluid. The products of combustion are caused to recirculate within the main chamber and thereafter they leave via a secondary chamber or chambers, mounted to each side of the main chamber for exhausting to atmosphere. Preheated tubes are mounted in these secondary chambers. The secondary chamber could alternatively be mounted on the top. These constructions are, for example, illustrated in British Pat. No. 1,407,905.

While the construction produces a reasonably satisfactory heat exchange between the products of combustion and the process fluid, there is significant room for improvement.

In British Pat. No. 1,487,455, there is illustrated a further construction which provides improved results. The burner is mounted on a bottom firing wall and projects its products of combustion through a secondary chamber and through a baffle having an aperture for the or each burner. The main chamber again has the hot products of combustion circulating therein and these exit through the aperture into the secondary chamber and thence to an exhaust flue.

While this provides an improved arrangement, it is fairly costly and again there is room for improvement in efficiency.

It is now proposed, according to the present invention, to provide a heater for heating a process fluid comprising an elongate main chamber, having longitudinal walls and end walls, at least one high intensity burner mounted to project its products of combustion into the main chamber in a direction transverse to the axis of the main chamber, an annular secondary chamber surrounding the longitudinal walls of the main chamber, a first set of heat exchanger tubes in the main chamber, and a second set of heat exchanger tubes in the secondary chamber, at least one inlet to the secondary chamber being provided from the main chamber and at least one flue outlet from the secondary chamber being positioned at a location opposite to the inlet from the main chamber.

Such a construction can be made relatively compact and can have a high thermal efficiency. It can be particularly compact if it is constructed so that the main chamber is cylindrical and the secondary chamber is of annular cross-section concentric to the cylindrical main chamber.

Advantageously, a plurality of burners, for example four, are provided at spaced locations along the length of the main chamber.

In order to ensure thorough circulation of the products of combustion in the main chamber, the inlet or inlets to the secondary chamber are preferably located adjacent to the burner or burners. For this purpose, the or each burner may be mounted in a refractory shield which has "wings" which extend into the secondary chamber and are so shaped as to guide the products of combustion from the main chamber into the secondary chamber.

For best thermal efficiency, the burner or burners are mounted at the bottom of the main chamber with the flue outlet or outlets disposed at the top of the secondary chamber.

The connections to the heat exchanger tubes are preferably such that the fluid to be heated flows first through the second set of tubes (in the secondary chamber) and then through the first set of tubes (in the main chamber) which are connected in series therewith. If the first set of tubes are arranged in at least two vertical banks, one on each side of the or each burner, and the second set of tubes are connected to the lower end of each bank, then the second set of tubes can be used as preheaters giving a relatively cool flue gas venting to atmosphere, and the feeding of the process fluid to the lower end of the banks assists in convection flow of the process fluid.

Advantageously, a heat shield is provided between the main chamber and the secondary chamber and this may be formed for example, of rock/mineral wool clad with stainless steel plates arranged in overlapping manner to provide a sliding joint to allow for expansion and contraction thereof, during the change in temperature conditions. Alternatively, the heat shield may be formed of composite board materials.

The construction of the present invention is such that high velocity flue gases are discharged into the hot zones at temperatures in the order of 1650° C. and the arrangement can give a thermal efficiency of approximately 85%.

If the construction is made with a cylindrical main chamber, it can be particularly compact and robust, thus saving in space and capital cost. The design is such that minimal thermal insulation and minimal refractory are required because the main chamber is completely encased in the secondary chamber.

This gives rise to low maintenance costs. Because of the compact construction, there will be low thermal inertia in the system and quick response to changes in the heat demand can be readily met.

The main chamber and secondary chamber can be mounted on legs and beneath the whole structure, the necessary instrumentation can be provided which gives ready access to this instrumentation.

If desired, manholes can be provided in the end walls of the main chamber to give ready access for maintenance purposes. The heat exchanger tubes, particularly in the secondary chamber, can be of serpentine structure and can be arranged so that longitudinal expansion can easily take place. Furthermore, the arrangement can be such that the heat exchanger tubes can be withdrawn in one axial direction whilst still mounted on header tubes, thus giving ready maintenance thereof.

Figure 2:
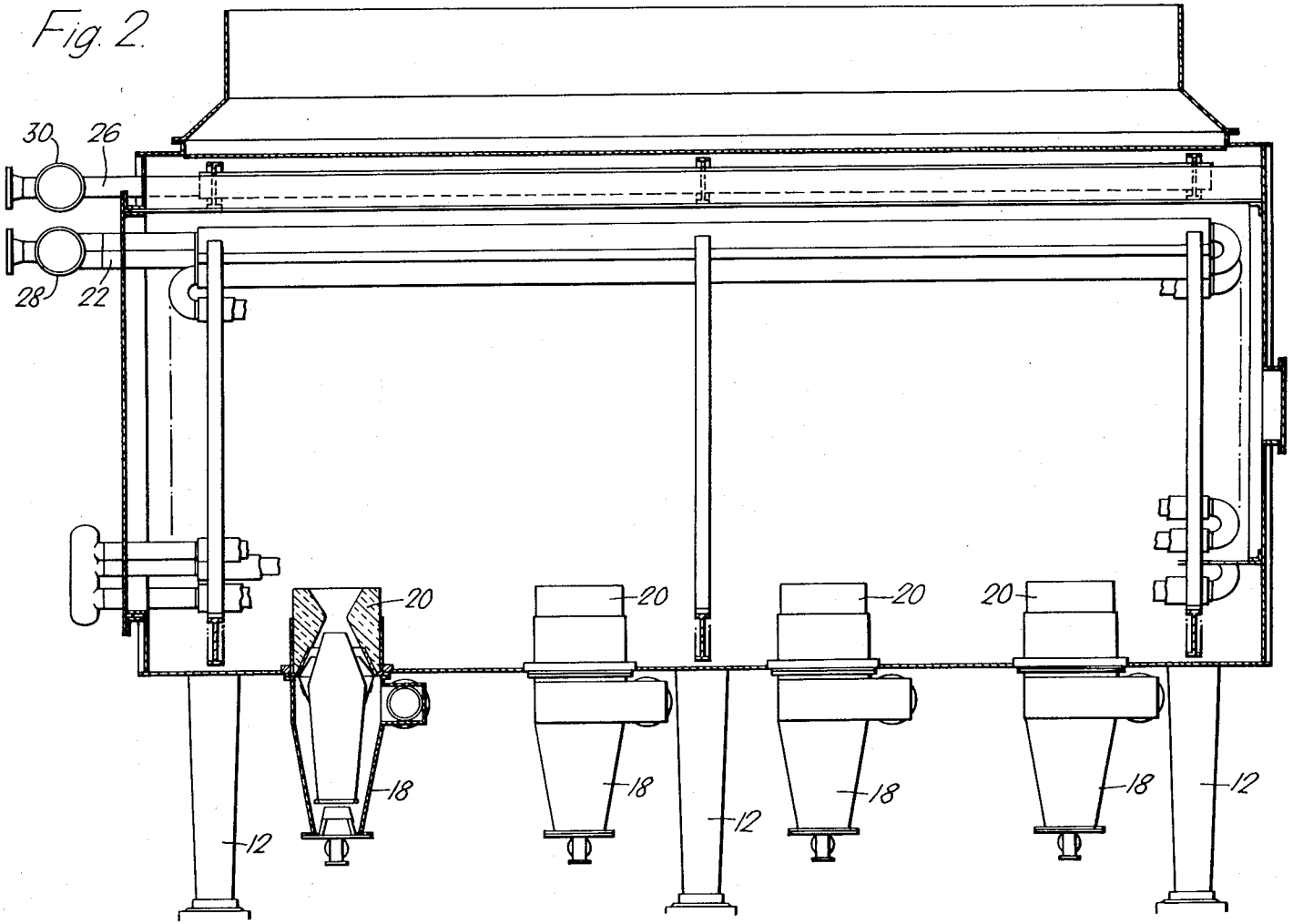

In order that the present invention may more readily be understood, the following description is given, merely by way of example, reference being made to the accompanying drawings, in which:

FIG. 1 is an end view, in cross-section, of one embodiment of heater according to the present invention; and FIG. 2 is a side elevation, again in section, of the heater of FIG. 1.

The heater indicated by the general reference numeral 10 is mounted on six legs 12 and comprises a main chamber 14 of generally cylindrical construction surrounded by an annular secondary chamber 16.

As can be seen in FIG. 2, four high intensity burners 18 are mounted at axially spaced locations of the heater, and each is provided with a discharge nozzle 20 providing a fan-shaped flame whereby the products of combustion are projected transverse to, and indeed at right angles to, the axis of the cylindrical main chamber 14. Two banks 22 and 24 of a first set of heat exchanger tubes are arranged to run longitudinally of the main chamber and are each provided with fins (not shown) and are mounted on supports indicated schematically at 25.

Within the secondary annular chamber 16 are a second set of tubes 26 which are arranged in a serpentine fashion. The tubes 22 and 26 are each connected to headers at the same end of the heater, so that the two sets of tubes can be withdrawn together for servicing purposes. In fact the two sets of headers can be seen in FIG. 2 at 28 and 30.

In order to reduce the noise of the whole arrangement, muffle plates 32, 33 are mounted on the inner and outer walls of the secondary chamber and cause an undulating flow of the gases in the secondary chamber, on their way to a flue gas exit box 34 which is connected firstly to an outlet 35 of the secondary chamber 16 and to a stack 36.

The lower end of the secondary combustion chamber is formed with a refractory shield indicated by the general reference numeral 40 and having wings 41 and 42 extending into each side of the secondary chamber. At the centre of this shield 40 there are set the refractory nozzles 20.

It will be appreciated that inlets 43 and 44 are provided adjacent the nozzles 20 so that gases can flow from the main chamber into the secondary chamber.

The drawing also shows manholes 50 at one end of the main chamber, to allow access for maintenance workers.

A further heat shield 55 is provided between the secondary chamber and the main chamber, on the inner wall of the main chamber, and this may be formed, for example, of rock or mineral wool which is clad with stainless steel plates which may be arranged in overlapping manner to provide a sliding joint to allow for expansion and contraction during heating up and cooling down of the heater. It is also possible for a further heat shield to be provided around the exterior to contain the heat well within the secondary chamber.

In operation, the products of combustion flow very rapidly upwardly to the centre between the two banks of tubes 22, 24 and are caused to flow outwardly and downwardly to the bottom again where they may be recirculated over the heat exchange tubes 22, 24 so that a high degree of heat exchange takes place. The gases will eventually exit through the openings 43, 44, passing over the wings 41 and 42 of the shield 40 and into the secondary chamber 16 from which they flow to the opposite end of the secondary chamber, through the outlet 35 into the exit box 34 and finally out through the stack 36.

The tubes 26 are fed with the process fluid to be heated, and thereby preheat this process fluid, which then flows in series into the tubes 22, 24 and gets progressively heated as it rises upwardly through these tubes before exiting through a discharge manifold.

The construction, it will be appreciated, is extremely compact and robust, so that it takes up a relatively small space. The heat exchange efficiency is very high, being of the order of 85% and the maintenance is very easy.

Instrumentation (not shown) may be provided beneath the heater, that is between the legs 12 so that it can be readily viewed and maintained.

Details of the construction of the burner are not discussed here because they may be conventional. The actual construction illustrated forms the subject of copending U.S. patent application Ser. Nos. 257,273 and 257,205, both filed Apr. 24, 1981, the disclosure of which is incorporated herein by reference.

I claim:

1. A heater for heating a process fluid, said heater comprising, in combination:

(a) an elongated main chamber;

(b) a cylindrical wall extending axially of said chamber;

(c) end walls of said chamber;

(d) at least one high intensity burner mounted to project its products of combustion into the main chamber in a direction transverse to the axis of the main chamber;

(e) an annular secondary chamber concentrically surrounding the cylindrical wall of the main chamber;

(f) a first set of heat exchanger tubes in the main chamber, extending substantially parallel to the axis thereof;

(g) a second set of heat exchanger tubes in the secondary chamber, extending substantially parallel to the axis thereof, the adjacent tubes of said first and second sets being laterally spaced to allow the products of combustion to flow therearound;

(h) at least one combustion gas inlet to the secondary chamber comprising at least one refractory shield in which at least one said high intensity burner is mounted in the main chamber, and wings on said refractory shield which extend into the secondary chamber and which are so shaped as to guide gases from the main chamber into the secondary chamber; and (i) at least one flue outlet from the secondary chamber positioned at a location opposite to the combustion gas inlet from the main chamber.

2. A heater as claimed in claim 1, wherein a plurality of burners are provided at spaced locations along the length of the main chamber.

3. A heater as claimed in claim 1, wherein the or each burner is mounted at the bottom of the main chamber and with each flue gas outlet being disposed at the top of the secondary chamber.

4. A heater as claimed in claim 1, and further comprising connections to the heat exchanger tubes, said connection being such that the fluid to be heated flows first through the second set of tubes and then through the first set of tubes which are connected in series therewith.

5. A heater as claimed in claim 4, wherein the first set of tubes are arranged in at least two vertical banks, one on each side of the or each burner, and the second set of tubes are connected to the lower end of each bank.

6. A heater as claimed in claim 1, and further comprising a heat shield between the main chamber and the secondary chamber.

7. A heater as claimed in claim 6, wherein the heat shield is formed of composite board material.

8. A heater for heating a process fluid, said heater comprising, in combination:

(a) an elongate main chamber;

(b) a cylindrical wall extending axially of said chamber;

(c) end walls of said chamber;

(d) at least one high intensity burner mounted to project its products of combustion into the main chamber in a direction transverse to the axis of the main chamber;

(e) an annular secondary chamber concentrically surrounding the cylindrical wall of the main chamber;

(f) a heat shield between the main chamber and the secondary chamber, said heat shield being formed of rock/mineral wool clad with stainless steel plates arranged in an overlapping manner to provide a sliding joint to allow for expansion and contraction;

(g) a first set of heat exchanger tubes in the main chamber, extending substantially parallel to the axis thereof;

(h) a second set of heat exchanger tubes in the secondary chamber, extending substantially parallel to the axis thereof, the adjacent tubes of said first and second sets being laterally spaced to allow the products of combustion to flow therearound;

(i) at least one combustion gas inlet to the secondary chamber located adjacent to a burner in the main chamber; and (j) at least one flue outlet from the secondary chamber positioned at a location opposite to the combustion gas inlet from the main chamber.

* * * * *